United States Patent [19]

Hansen et al.

[11] 4,009,760

[45] Mar. 1, 1977

[54] APPARATUS FOR ROOF DRILLING

[75] Inventors: Lloyd B. Hansen, Bridgeport; Eugene R. Smarrella, Shinnston, both of W. Va.

[73] Assignee: Carmet Company, Pittsburgh, Pa.

[22] Filed: May 6, 1976

[21] Appl. No.: 683,986

Related U.S. Application Data

[63] Continuation of Ser. No. 554,878, March 3, 1975, abandoned.

[52] U.S. Cl. ..... 175/320; 175/393; 175/422; 285/14

[51] Int. Cl.[2] ..... E21B 17/00; E21B 17/04; E21C 15/00

[58] Field of Search ..... 175/320, 62, 53, 57, 175/173, 393, 422; 61/63; 285/45 B, 14

[56] References Cited

UNITED STATES PATENTS

| | | | |
|---|---|---|---|
| 1,894,446 | 1/1933 | McKenny | 175/62 X |
| 2,263,579 | 11/1941 | Hokanson | 175/320 X |
| 2,693,345 | 11/1954 | Martin et al. | 175/320 X |
| 2,902,832 | 9/1959 | Levy et al. | 175/320 X |
| 2,979,141 | 4/1961 | Kandle | 175/62 X |
| 3,187,825 | 6/1965 | Bower, Jr. | 175/320 X |
| 3,304,816 | 2/1967 | Galorneau | 175/320 X |
| 3,341,237 | 9/1967 | Anzalone | 175/320 X |
| 3,519,091 | 7/1970 | Leibee et al. | 175/320 |
| 3,554,306 | 1/1971 | Wilburn | 175/320 |
| 3,722,604 | 3/1973 | Lesher | 175/320 X |

*Primary Examiner*—Stephen J. Novosad
*Attorney, Agent, or Firm*—Vincent G. Gioia; Robert F. Dropkin

[57] ABSTRACT

An assembly for drilling a hole in a roof to a greater depth than the height of the chamber therebelow includes a starter-driver bar having a first end adapted to be driven by a motor and a second end having a female socket therein, a rod extension including a male end shaped to be received in said female socket and a female socket at its other end of the same cross-sectional size and shape as the first named female socket, and a bit having a male shank of the same cross-sectional shape as said male end. A starter hole is first drilled using the starter-driver with the drill bit in its top and a motor connected to its lower end. Drilling then is continued with an assembly consisting of a first rod extension between the bit and starter-driver. Additional rod extensions are inserted between the starter-driver and the bottom rod extension until a hole of the desired depth is obtained.

3 Claims, 8 Drawing Figures

APPARATUS FOR ROOF DRILLING

This is a continuation of application Ser. No. 554,878, filed Mar. 3, 1975, now abandoned.

This invention relates to a method and apparatus for roof drilling and more particularly to the drilling of holes in the roof of mine chambers where the depth of the hole is greater than the height of the chamber. The apparatus used in the conventional method of drilling such holes, in addition to the bit and motor, includes a starter rod, a driver, a lead extension and a middle extension. In drilling the hole the lower end of the starter rod is connected to the motor and the bit is secured in a socket in the top of the starter rod. The hole is then drilled to a depth as great as practical or possible. The starter rod and bit are then removed and the lead extension connected to the bit and the driver. The drilling of the hole is then continued until it reaches a depth as great as practical or possible. The drive and lead extension are then separated and a middle extension inserted there between and the drilling continued. Additional middle extensions are inserted as required.

It will be seen that four types of drill rods used which require that some of each be kept in stock. Since it is necessary for the operator to be constantly changing rods, his efficiency is low. The efficiency is also lowered because of the number of times the entire assembly must be removed from the hole and another assembly reinserted.

It is therefor an object of our invention to provide a roof drilling assembly which requires fewer pieces than formerly.

Another object is to provide a more efficient method of drilling a roof hole.

These and other objects will be more apparent after referring to the following specification and attached drawings in which.

Figure 6:
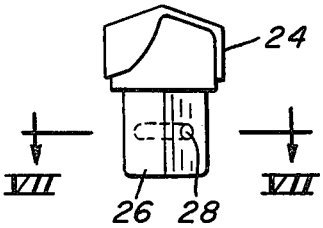
FIG. 6 is an elevation of a conventional drilling bit.
Figure 7:
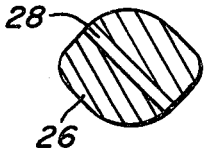
FIG. 7 is a view taken on the line VII—VII of FIG. 6.
Figure 1:
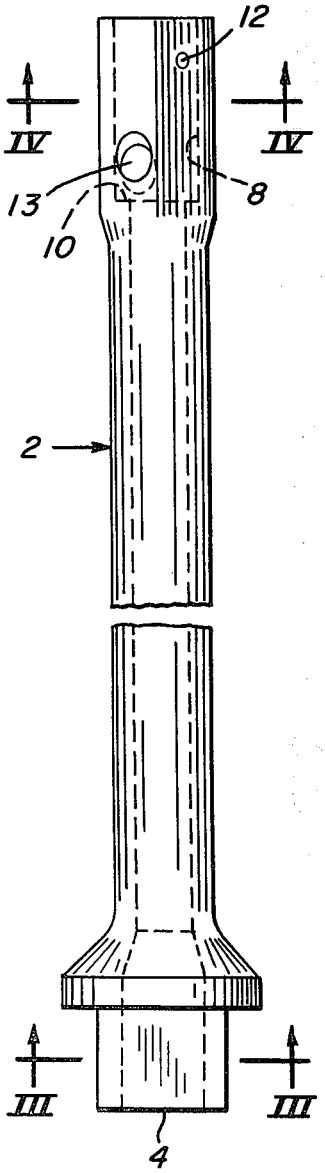
FIG. 1 is an elevation of the starter-driver of our invention.
Figure 2:
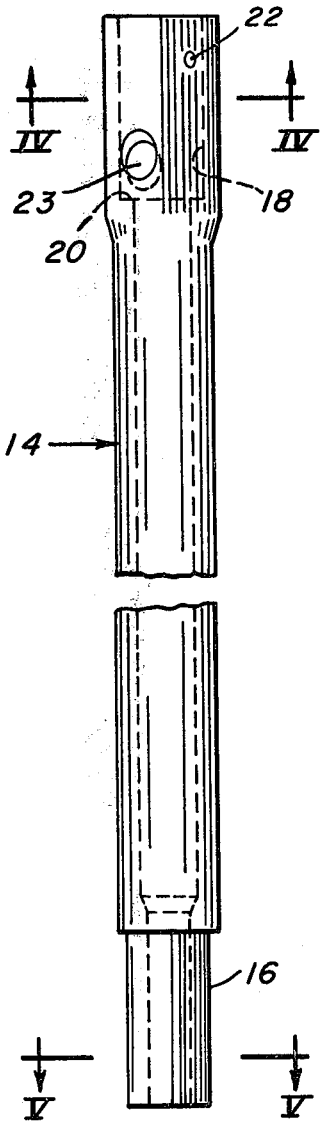
FIG. 2 is an elevation of the rod extension of our invention.
Figure 3:
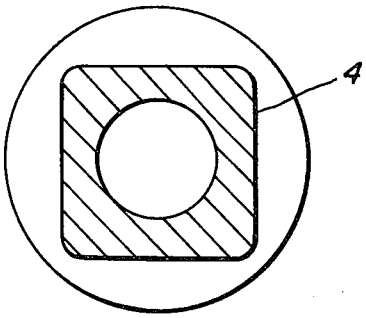
FIG. 3 is a view taken on the line III—III of FIG. 1.

Referring more particularly to the drawings, reference numeral 2 indicates the starter-driver bar of our invention. Shank 4 at one end of the starter-driver 2 is shaped to be driven by a motor 6. The other end of starter-driver has a female socket 8 therein. It will be seen that the socket 8 has a non-circular shape and has a shoulder 10 at its inner end. Aligned holes 12 are provided through the walls of socket 8 and a hole 13 adjacent its bottom. A rod extension 14 includes a male end 16 and a female socket 18 at its other end. The male end 16 has a cross section of such size and shape as to be received snugly in socket 8 or socket 18 of another rod extension. It will be seen that sockets 8 and 18 are identical with socket 18 having a shoulder 20, aligned holes 22 and hole 23 corresponding to shoulder 10, aligned holes 12 and hole 13 of socket 8. Drill bit 24 includes a shank 26 having a cross-section essentially the same as male end 16. A hole 28 is provided through shank 30 such that it will be in alignment with holes 12 or 22 when inserted into sockets 8 or 18. A locking pin 32 inserted through the aligned holes will retain the bit in the socket. It will be seen that the bars 2 and 14 have axial holes 34 and 36 therein. As is conventional a suction is applied to the bottom of bar 2 to suck dust through holes 13 and 23 downwardly through the bars.

Figure 8:
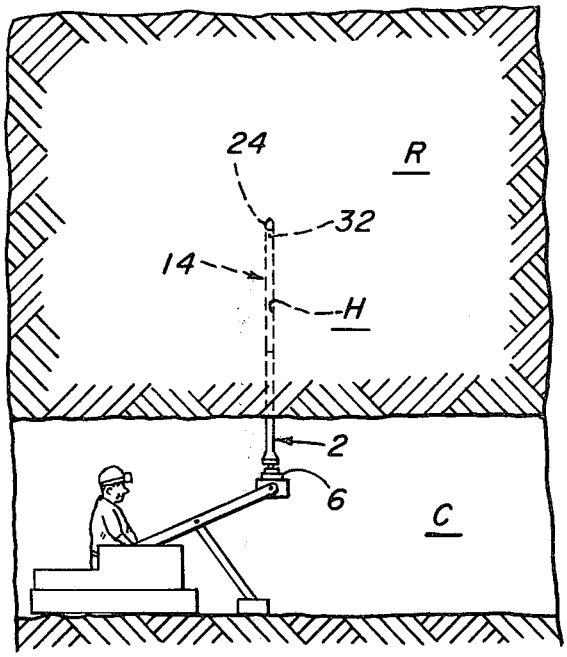
FIG. 8 is a schematic elevation showing a drill assembly in place in a mining chamber.
Figure 4:
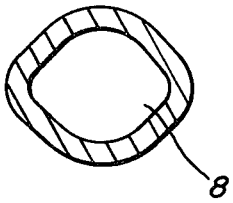
FIG. 4 is a view taken on the line IV—IV of FIGS. 1 and 2.
Figure 5:
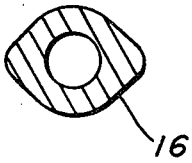
FIG. 5 is a view taken on the line V—V of FIG. 2.

When drilling a hole H in a roof R to a depth greater than chamber C, the bit 24 is inserted in socket 8 and the lower end of starter-driver 2 connected to motor 6. A hole is then drilled as deep as practical after which the bit is removed from socket 8 and the end 16 of a rod extension 14 inserted in place thereof. The bit 24 is then inserted in socket 18 and the drilling is continued to as great a depth as possible. This is the assembly shown in FIG. 8. To continue the drilling it is not necessary to remove the bit 24 and extension 14 from the hole. It is only necessary to add an additional rod extension 14 between the starter-driver and the first rod extension. This operation is continued until the desired depth of hole is obtained. Each time it is only necessary to add an additional rod extension between the starter-driver and lowest rod extension.

While one invention has been shown and described, it is to be understood that various adaptations and modifications may be made within the scope of the invention.

We claim:

1. A roof drilling assembly comprising a starter-driver bar including a first end adapted to be driven by a motor and a second end having a female socket therein, a rod extension having a male end shaped to be received in said female socket and a female socket at its other end of the same cross-sectional size and shape as the first named female socket, and a bit having a male shank of the same cross-sectional shape as said male end, said sockets, male end and shank being non-circular in transverse cross-section, the bottom of each of said female sockets having a shoulder at its inner end, each of said starter-driver bar and rod extension having an axial hole therethrough, and each socket having a transverse hole through its wall spaced from said shoulder, said bit shank being so received in said female socket of said driver bar or rod extension that the axial hole therein communicates with the corresponding transverse hole and the length of said male end received in said socket being such that it covers said transverse hole.

2. A roof drilling assembly according to claim 1 including a plurality of said rod extensions adapted to be assembled end to end between said starter-drive and said bit.

3. A roof drilling assembly according to claim 1 in which each socket has aligned holes through its walls, and each shank and male end has a hole therethrough adapted to be aligned with the corresponding aligned holes in the corresponding socket to receive a locking pin.

* * * * *